US007654044B2

(12) United States Patent
Borland

(10) Patent No.: US 7,654,044 B2
(45) Date of Patent: Feb. 2, 2010

(54) HURRICANE PROTECTION SYSTEM

(76) Inventor: Allen Borland, 204 Royal Palm Ave., Surf City, NC (US) 28445

( * ) Notice: Subject to any disclaimer, the term of this patent is extended or adjusted under 35 U.S.C. 154(b) by 572 days.

(21) Appl. No.: 11/506,700

(22) Filed: Aug. 18, 2006

(65) Prior Publication Data

US 2008/0040994 A1 Feb. 21, 2008

(51) Int. Cl.
*E06B 3/26* (2006.01)

(52) U.S. Cl. ..... 52/202; 52/203; 292/281; 292/283; 292/DIG. 11

(58) Field of Classification Search ..... 52/202, 52/203, 19, 204.53, 204.54; 49/57, 62; 403/316, 403/318, 319; 16/382, 261, 270, 271; 292/32, 292/33, 42, 137, 138, 146, 148, 150, 281, 292/283, 284, 340, DIG. 11
See application file for complete search history.

(56) References Cited

U.S. PATENT DOCUMENTS 2,012,388 A * 8/1935 Goodman ..... 52/202
5,193,308 A * 3/1993 Davidian ..... 49/381
5,335,452 A 8/1994 Taylor
5,339,579 A * 8/1994 Woodyer et al. ..... 52/107
5,343,668 A 9/1994 Gonzalez
5,457,921 A 10/1995 Kostrzecha
5,487,244 A 1/1996 Hill
5,507,118 A * 4/1996 Brown ..... 49/61
5,603,190 A 2/1997 Sanford
5,622,020 A 4/1997 Wood
5,660,010 A 8/1997 Sayers
5,737,874 A 4/1998 Sipos et al.
5,852,903 A 12/1998 Astrizky
5,907,929 A * 6/1999 Poma et al. ..... 52/78
5,911,660 A 6/1999 Watson
5,941,033 A 8/1999 Adams
6,205,713 B1 * 3/2001 Thompson et al. ..... 49/465
6,219,978 B1 * 4/2001 Wood ..... 52/202
6,263,625 B1 7/2001 LaPointe
6,293,059 B1 * 9/2001 Goodwin ..... 52/202
6,296,041 B1 * 10/2001 Cicero ..... 160/327
6,334,282 B1 1/2002 Wood
6,341,455 B1 1/2002 Gunn
6,363,670 B1 4/2002 Dewitt
6,393,777 B1 * 5/2002 Renfrow ..... 52/202
6,502,355 B1 * 1/2003 Bori ..... 52/202
6,532,702 B1 * 3/2003 Scribner ..... 52/202
6,820,381 B1 11/2004 Ballough
6,978,579 B1 * 12/2005 Trinca ..... 52/203

* cited by examiner

*Primary Examiner*—Richard E Chilcot, Jr.
*Assistant Examiner*—James J Buckle, Jr.
(74) *Attorney, Agent, or Firm*—MacCord Mason PLLC

(57) ABSTRACT

A window or door with a radially extending metal or vinyl casing flange mounted in an opening of a building having vinyl siding is protected from hurricanes and other violent weather by providing a panel having dimensions greater than the opening and bracket receiving slots; and a plurality of L-shaped brackets having base plates and perpendicular mounting plates. The bracket base plates are inserted between the window flange and the vinyl siding and secured to the building with fasteners, which are inserted into a wooden frame surrounding the building opening. The panel is then positioned over the opening, with the mounting plates inserted through the slots. The panel is secured in place by temporary fasteners, such as cotter keys.

20 Claims, 4 Drawing Sheets

HURRICANE PROTECTION SYSTEM

BACKGROUND OF THE INVENTION (1) Field of the Invention

The present invention relates to systems for temporarily covering windows and doors during violent weather, and in particular to systems for temporarily covering windows and doors of manufactured homes having vinyl siding and metal or vinyl window casings.

(2) Description of the Prior Art

The prior art includes numerous systems for temporarily covering windows and doors during hurricanes and other violent weather that can break or damage windows and doors, causing damage to the interior of the building. Generally, such systems are comprised of a panel of impervious material that has an area larger than the opening to be covered, and means for temporarily attaching the panel over the opening.

The most common system used is simply a plywood panel that is nailed over the opening, with the nails being driven through the plywood panel adjacent its edges and into the frame of the window or door. In more complex systems, some type of panel support is permanently attached to the building, with the panel being temporarily mounted onto the support during inclement weather. For example, a horizontal U-shaped rail may be mounted to the building below the opening, with a panel attachment means being mounted above the opening. The lower edge of the panel is dropped into the rail and the upper end of the panel is temporarily attached above the opening.

While these prior art systems are suitable to different degrees in protecting the covered openings, none of the prior art systems are specifically designed to address the requirements of manufactured housing. In addition, many prior art systems are outside the price range of many owners of manufactured homes.

The term "manufactured housing" or "manufactured homes" as used herein is intended to encompass homes that are built entirely within a factory, and also homes that are built in segments or modules for transportation to the building site (modular homes) and homes that are shipped as panels, e.g., walls, to the building site (panelized homes.) For purposes of economy and ease of construction, manufactured homes are commonly faced with vinyl siding, i.e., elongated horizontal vinyl strips having a parallel upper and lower edges and a downwardly and outwardly projecting front surface, which may be textured to give a wood or other appearance. These segments may be manufactured as individual strips or boards, or manufactured as a panel of integral segments having the appearance of separate overlapped strips. Manufacture is normally by extrusion. The lower edge of each segment joins or overlaps the upper edge of the immediately lower segment. Vinyl siding is attached to the building exterior wall by inserting a fastener through the upper edge of the siding strip or panel and into the building. The fastener may be inserted through a slot in the siding to allow for expansion and contraction.

Window openings in the exterior walls of the building are framed with wooden headers, sills and jambs along each side of the opening. The vertical jambs are normally constructed of two abutting 2×4 studs. The window inserted into the opening includes an aluminum or vinyl casing with a radially projecting outer flange spaced outwardly from and parallel to the vinyl siding. Door openings are constructed in a similar manner.

During construction, the windows and doors are inserted into the openings and attached by inserting fasteners, e.g., screws, nails or staples into the opening casing. Vinyl siding is then attached to the sheathing or exterior surface of the building with the ends of the siding being inserted beneath the flange to prevent water from entering behind the vinyl siding.

Due to the nature of the materials, it is not desirable to drive nails or other fasteners through the exposed casin of the aluminum or vinyl window. In addition, mounting supports for storm panels onto the vinyl siding can bend and distort the panels. Accordingly, prior art systems are unsuitable for this kind of building construction.

SUMMARY OF THE INVENTION

In accordance with the present invention, a system is provided that is particularly adapted for use with manufactured housing, and in particular a system that can protect the openings, e.g., windows and doors, of manufactured housing without unnecessary damage to the building windows or siding, and at a cost that is within the range of most owners of manufactured housing.

Generally, the present system is comprised of a cover panel, a plurality of attachment brackets mountable on the building to temporarily support the panel, first fasteners to secure the brackets to the building, and second fasteners to secure the panel to the brackets. The system may also include shims positionable between the brackets and the vinyl siding.

More specifically, the panel of the invention is sized to extend beyond the outer periphery of the opening, i.e., the panel has height and width dimensions greater than the corresponding dimensions of the window or door casing. Different sized panels will, of course, be used for different sized openings. The panels also have a given thickness, e.g., normally from about 0.25 to about 0.75 inch. The panels may be constructed of various materials, e.g., metal or plastic, but are more normally constructed of wood, in particular plywood, for cost reasons.

The panel includes a plurality of vertical slots adjacent the panel side edges for receipt of attachment brackets. Each slot has a given height and a given width. Preferably, each panel includes at least two vertically aligned slots along each side.

The attachment brackets each include a base plate having a given thickness, an inner edge and an outer edge; and a mounting plate having a given thickness, an inner edge and an outer edge. The mounting plate is perpendicular to the base plate with the inner edges of the plates being joined. Preferably, the attachment brackets are L-shaped brackets.

The bracket base plate includes through-holes for insertion of first fasteners, e.g., screws, through the base plate and into the studs adjacent the sides of the wall opening. The mounting plates include through-holes for insertion of releasible fasteners to secure the panel to the brackets. The mounting plate is sized for insertion into a panel slot, and preferably has a width approximately equal to the length of the slot and a thickness approximately equal to the thickness of the slot. The through-holes in the mounting plate are spaced at a distance equal to the panel thickness from the window frame when the brackets are mounted onto the building. If desired, the mounting plates can include different holes mounted at different spacings to accommodate panels of different thicknesses.

In order to mount the panel over an opening, the outer ends of the bracket base plates are inserted between the radial flange of the window casing and the vinyl siding. The width of the plate between its inner and outer edges is greater than the width of the flange, so that a part of the plate including fastener holes projects beyond the edge of the flange.

Fasteners are then inserted through the holes in the base plates and into the studs on the sides of the opening. If desired, shims can be inserted between the base plate and the vinyl siding, with the shims abutting the lower edges of vinyl siding strips covered by the base plates. The fasteners can be inserted through the shims to hold the shims in place. The shims may be rectangular strips having a thickness approximately equal to the thickness of the vinyl strip lower edge so that the shim can be placed against a siding strip front surface and against the lower edge of the immediately higher strip.

The positions of the brackets will correspond to the positions of the slots in the panel so that the slots in the panel can be fitted onto the mounting plates. After mounting of the panel onto the mounting plates, second fasteners, e.g., cotter keys, are inserted through the holes in the mounting plates. If desired, the cotter keys can be opened to secure the panel in place.

As a result of the above configuration, a panel can be securely mounted over an opening in the wall of a manufactured home with vinyl siding and metal or vinyl cased windows without damage to the siding or casing. At the same time, the system is easy to install and remove, and is within the price range of the homeowner.

DETAILED DESCRIPTION OF THE INVENTION

Figure 1:
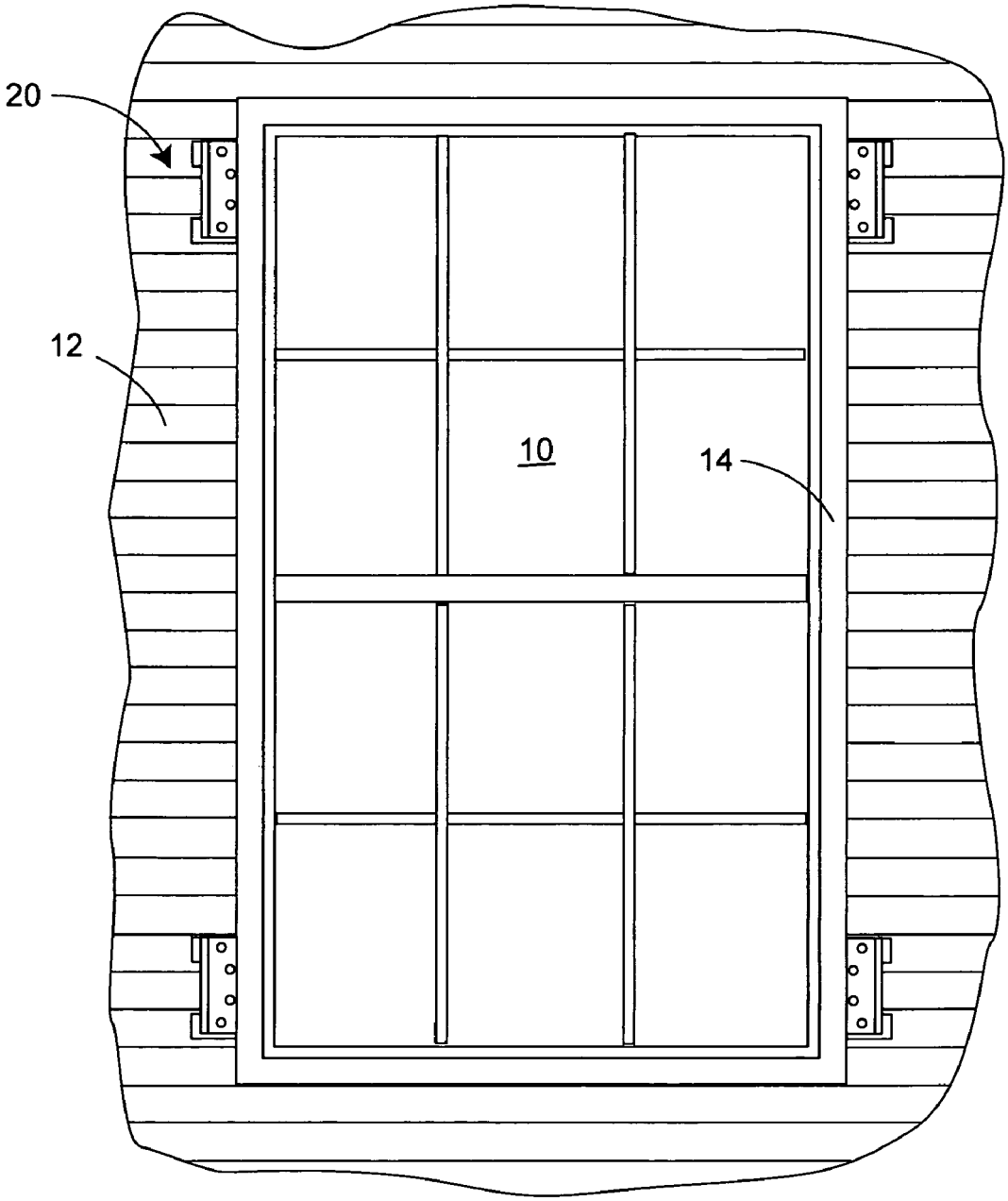
FIG. 1 is a front view of a window mounted in a vinyl-clad building opening with brackets mounted around the window casing.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

As the drawings of the preferred embodiment illustrate, the present invention relates to protective systems for temporarily covering windows or doors of a building during hurricanes and other violent weather. As shown, the invention is particularly adapted to protection of a window, generally 10, mounted in an opening of a building with vinyl siding 12. Window 10 includes a radially extending metal or vinyl casing flange 14, which is spaced from the wall of the building permitting insertion of the ends of strips of vinyl siding 12 beneath flange 14.

In the present invention, mounting brackets, generally 20, each include a base plate 22 that is inserted behind flange 14 and in front of siding 12, and a mounting plate 24 that extends outwardly from the building, perpendicular to flange 14 and plate 22. The inner ends of plates 22 and 24 are integrally joined to form an L-shaped bracket 20. Plate 22 includes through holes 26 for insertion of mounting screws 28 and mounting plate 24 includes through holes 30 for insertion of cotter keys 32.

As illustrated, siding 12 is comprised of a plurality of horizontal overlapping strips or boards 34 having an upper segment with an outwardly tapered front surface and a lower segment with a vertical front surface. Each strip terminates in a horizontal lower surface or wall of a given thickness. It will be understood, however, that the present invention is applicable to vinyl strips having other profiles. Also, instead of individual strips, the wall may be clad with extruded panels shaped in the form of a plurality of strips.

Shims 38 are inserted between the back of base plates 22 and siding 12 to prevent distortion of siding 12. Shim 38 is a rectangular strip of wood or vinyl or other screw penetrable material having a thickness corresponding to the lower edges of the strips of vinyl siding 12. The back of shim 38 may taper outward to correspond to the outward taper of the front surface of the vinyl strips.

Figure 2:
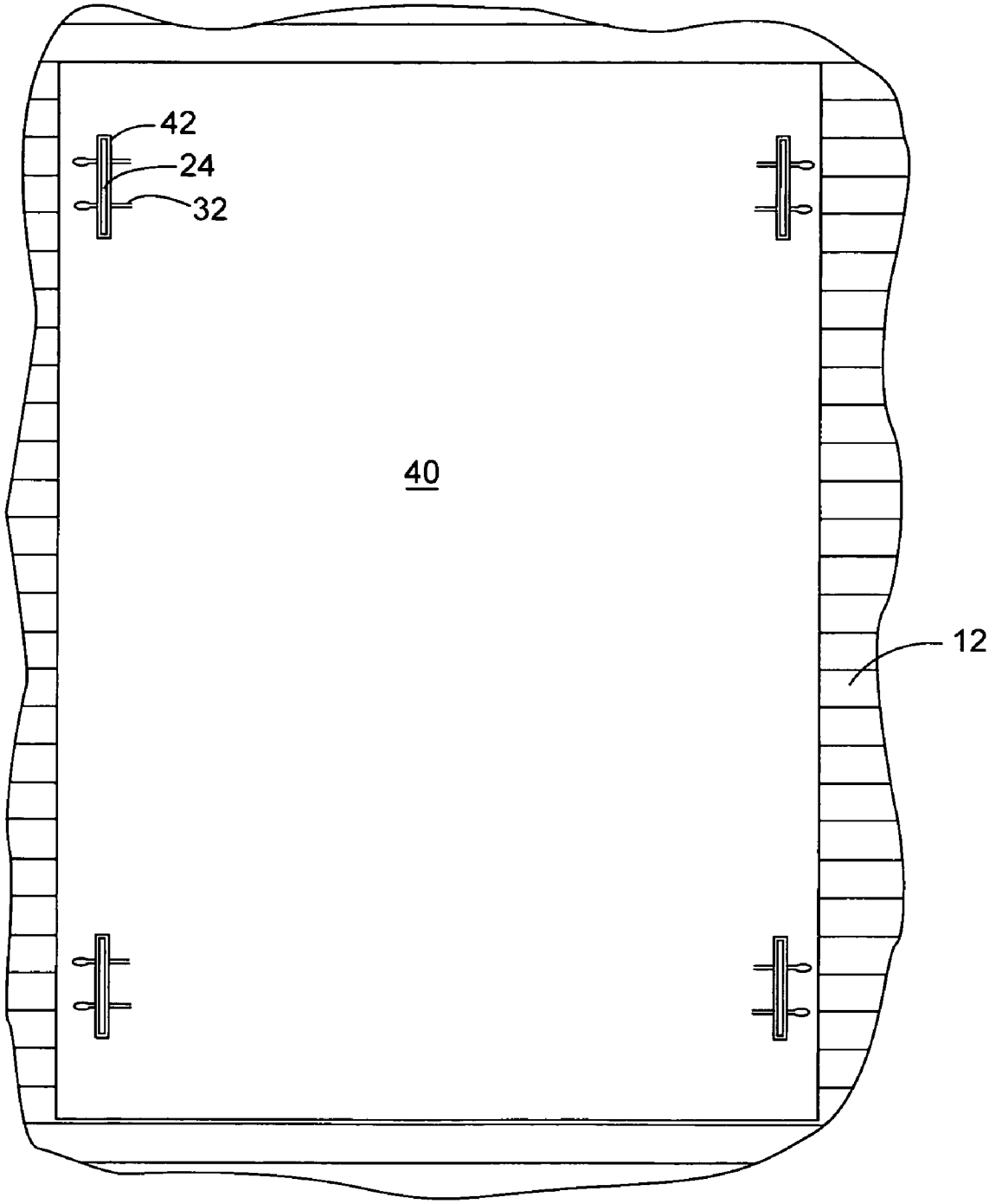
FIG. 2 is a front view of a window covered by a panel secured with mounting brackets.
Figure 3:
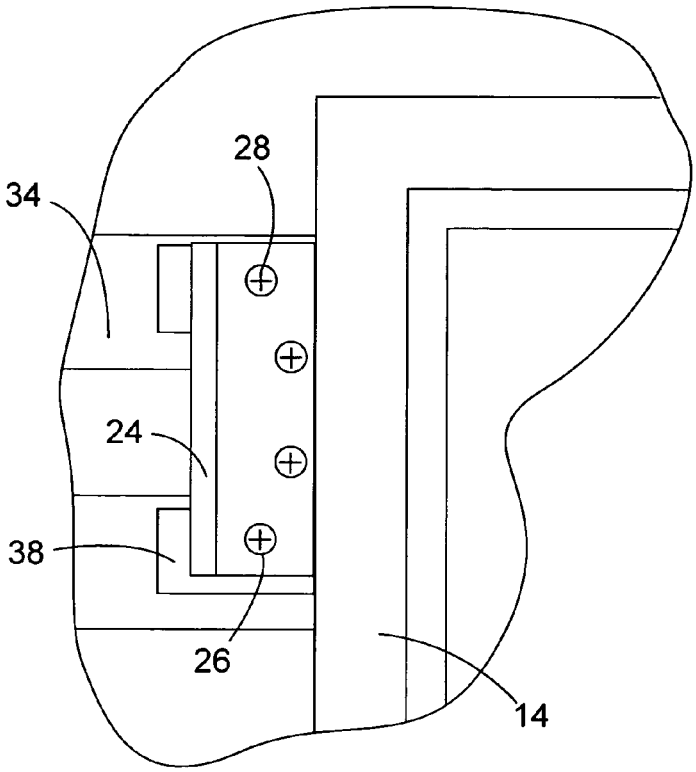
FIG. 3 is a detailed view of a corner of a window casing and a mounting bracket inserted behind the casing flange.
Figure 4:
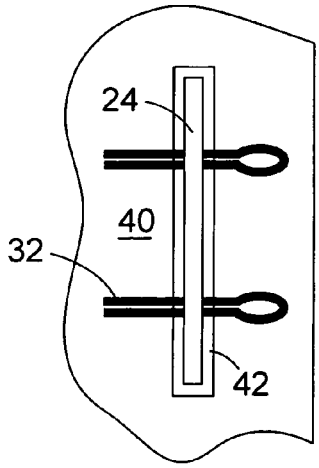
FIG. 4 is a detailed view of a section of panel with a mounting bracket extending through a hole in the panel and held in place with cotter keys.
Figure 7:
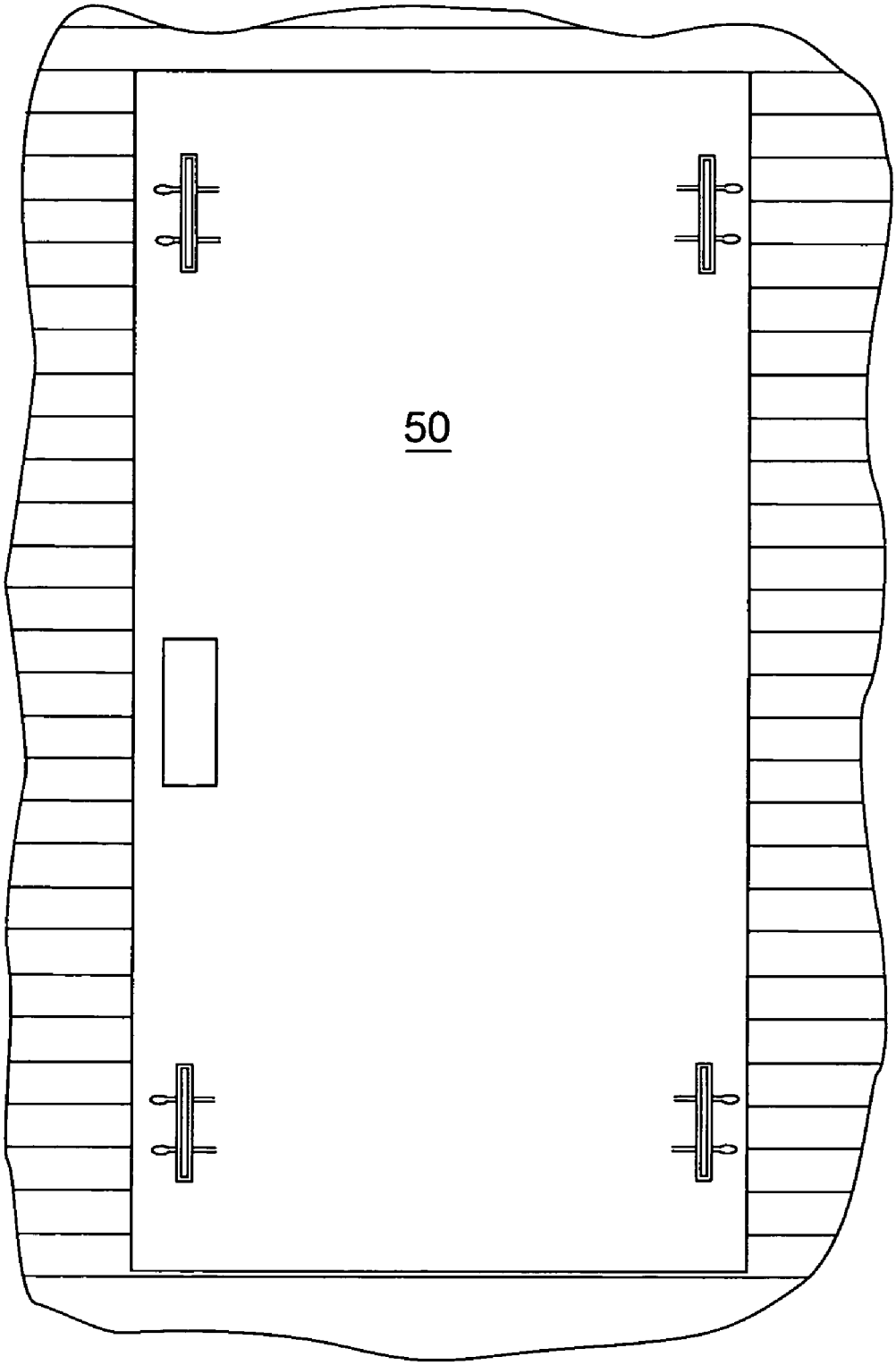
FIG. 7 is a front view of a door covered by a panel.

As illustrated in FIG. 2, a panel 40 with two vertically aligned slots adjacent each side is mounted onto brackets 20 by inserting mounting plates 24 through slots 42. Panel 40 is secured onto plates 24 with cotter keys 32 inserted through holes 30 in plate 22. FIG. 7 illustrates a door panel 50, covering a door (not shown) in a building covered with vinyl siding 12.

Figure 5:
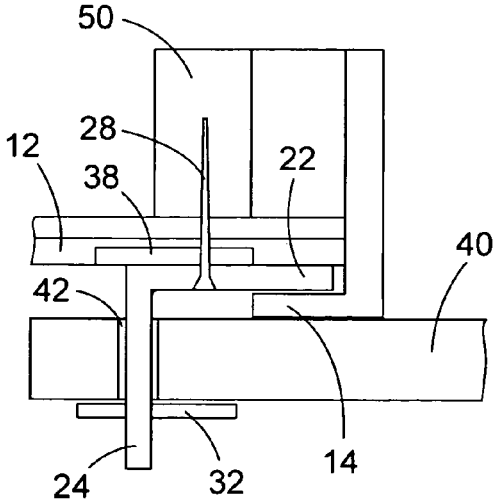
FIG. 5 is a sectional top view showing a window casing edge and building opening with framing, and a bracket and panel.
Figure 6:
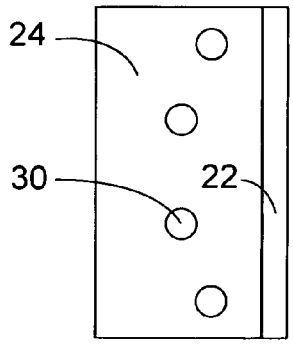
FIG. 6 is a side view of a bracket illustrating the mounting plate.

In the practice of the method of the present invention to cover window 10, a plurality of L-shaped brackets 20, each bracket having a base plate 22 sized for insertion between casing flange 14 and siding 12 and a mounting plate 24 sized for insertion through one of panel slots 42, are inserted beneath flange 14 preferably near the corners of window 10 with two brackets vertically aligned along each side of window 10. Brackets 20 are secured in place by screws 28 inserted through shims 40, siding 12 and into wooden frame 50 surrounding the building opening, specifically 2×4 s in the preferred embodiment illustrated in FIG. 5.

Panel 40 is then positioned over window 10 and mounting plates 24 are inserted through slots 42. Cotter keys 32 are inserted through holes 30 in mounting plates 24 to temporarily secure panel 40.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A system for temporarily covering a window or door mounted in an opening of a building having vinyl siding, said window or door including a casing with a radially extending flange spaced from and parallel to said siding comprising:

a) a panel with bracket receiving slots and dimensions greater than said opening;

b) a plurality of brackets, each bracket having a base plate sized for insertion between said flange and said siding and a mounting plate perpendicular to said base plate sized for insertion through one of said panel slots;

c) first fasteners for attaching said brackets to said building with said base plate beneath said flange; and d) second fasteners for releasibly attaching said panel to said brackets.

2. The system of claim 1, further including shims insertable between the base plates of said brackets and said siding.

3. The system of claim 1, wherein said building opening includes a wooden frame beneath and projecting beyond said flange, and said base plate includes a plurality of opening positioned above said wooden frame beyond said flange when said flange is inserted beneath said flange, said first fasteners being insertable through said base plate openings and into said wood frame.

4. The system of claim 1, wherein said panel has a given thickness and said mounting plate includes at least one opening spaced from said flange by a distance at least equal to said given thickness when said bracket is positioned beneath said flange, said second fasteners being releasibly insertable in said projecting plate holes.

5. The system of claim 1, wherein said panel is a rectangular plywood panel.

6. The system of claim 1, wherein said window or door frame is a metal or vinyl frame.

7. The system of claim 1, wherein said base plate includes through holes, said base plate extending beyond said flange to expose said through holes.

8. A system for temporarily covering a window including a metal or vinyl casing mounted in an opening of a building having vinyl siding and a wooden frame surrounding said opening, said window casing having a radially extending flange spaced from and parallel to said siding comprising:

a) a panel having a given thickness and height and width dimensions at least equal to the height and width dimensions of said wooden frame, said panel having bracket receiving slots positionable above said wooden frame;

b) a plurality of L-shaped brackets, each bracket having a base plate sized for insertion between said flange and said siding and a mounting plate perpendicular to said base plate sized for insertion through one of said panel slots, said base plate having first fastener openings positionable over said wooden frame beyond said flange, and said mounting plate having second fastener openings spaced from said flange by a distance at least equal to the given thickness of said panel when said bracket base plate is positioned beneath said flange;

c) first fasteners for attaching each of said brackets to said wooden frame with said base plate beneath said flange; and d) second fasteners for releasibly attaching said panel to said brackets.

9. The system of claim 8, further including shims insertable between said brackets and said siding.

10. The system of claim 8, wherein said first fasteners are a plurality of screws insertable through said base plate openings and into said wood frame.

11. The system of claim 8, wherein said second fasteners are a plurality of cotter keys insertable through said projecting plate holes.

12. The system of claim 8, wherein said panel is a rectangular plywood panel.

13. The system of claim 8, wherein said panel includes through holes spaced at a distance from said flange equal to the thickness of said panel.

14. The system of claim 1, wherein said base plate extends beyond said flange to expose said through holes.

15. A method for temporarily covering a window or door mounted in an opening of a building having vinyl siding, said window or door including a casing with a radially extending flange spaced from and parallel to said siding comprising:

a) providing a panel having dimensions greater than said opening, said panel having bracket receiving slots;

b) providing a plurality of L-shaped brackets, each bracket having a base plate sized for insertion between said flange and said siding and a mounting plate sized for insertion through one of said panel slots, said base plate having first fastener openings and said projecting plate having second fastener openings;

c) providing first fasteners for attaching each of said brackets to said building with said base plate beneath said flange;

d) providing second fasteners for releasibly attaching said cover to said brackets;

e) inserting the base plates of said bracket beneath said flange and securing said brackets to said building with said first fasteners;

f) positioning said panel over said opening and inserting the mounting plates of said brackets through said bracket receiving slots; and g) inserting said second fasteners through the openings in said mounting plates to temporarily secure said panel onto said brackets.

16. The method of claim 15, further including the step of inserting shims between said brackets and said vinyl siding.

17. The method of claim 15, wherein said panel has a given thickness and the distance between said flange and said mounting plate holes is equal to said given thickness when the base plate of said bracket is positioned beneath said flange.

18. The method of claim 15, wherein said opening is surrounded by a wooden frame and said first fasteners are inserted into said wooden frame.

19. The method of claim 15, wherein said plate is a rectangular plywood panel.

20. The method of claim 15, wherein said opening is a window opening.

* * * * *